US011636834B2

(12) United States Patent
Lu

(10) Patent No.: US 11,636,834 B2
(45) Date of Patent: Apr. 25, 2023

(54) HANDS-FREE PAGE TURNING FOR SHEET MUSIC

(71) Applicant: Crist Lu, Fremont, CA (US)

(72) Inventor: Crist Lu, Fremont, CA (US)

( * ) Notice: Subject to any disclaimer, the term of this patent is extended or adjusted under 35 U.S.C. 154(b) by 34 days.

(21) Appl. No.: 17/345,094

(22) Filed: Jun. 11, 2021

(65) Prior Publication Data

US 2022/0254322 A1 Aug. 11, 2022

Related U.S. Application Data

(60) Provisional application No. 63/148,020, filed on Feb. 10, 2021.

(51) Int. Cl.
*G10G 7/00* (2006.01)

(52) U.S. Cl.
CPC ..... *G10G 7/00* (2013.01)

(58) Field of Classification Search
CPC ..... G10G 7/00; G10G 1/00; B42D 9/06
See application file for complete search history.

(56) References Cited

U.S. PATENT DOCUMENTS 5,373,772 A 12/1994 Shemoul
6,935,058 B2 8/2005 Sadegh
7,019,203 B2 3/2006 Wolberg
7,540,464 B2 * 6/2009 Samari ..... A47B 23/04 84/486
7,939,739 B1 5/2011 Sadegh
2003/0063334 A1 * 4/2003 Mandel ..... H04N 1/19594 358/474
2005/0230592 A1 10/2005 Tillinghast

FOREIGN PATENT DOCUMENTS

WO WO-2009087261 A1 * 7/2009 ..... B25J 11/00

OTHER PUBLICATIONS

Online video titled "PageFlip Lite Automatic p. Turner" published on Nov 8, 2018. See YouTube at <https://www.youtube.com/watch?v=m—fOxg_gpHI>.

* cited by examiner

*Primary Examiner* — Kimberly R Lockett
(74) *Attorney, Agent, or Firm* — Ryuh Patent Law; Steven Yu

(57) ABSTRACT

An apparatus for hands-free turning of sheets in a booklet. A paper clip is attached to sheet(s) in the booklet. The apparatus comprises a swing arm with a magnet for magnetically attaching to the paper clip on the sheet(s). The swing arm sweeps from right-to-left with the sheet attached thereto, thereby turning the sheet over to the back page. This can be operated by a hands-free actuator, such as a foot pedal. The swing arm then makes a return stroke to turn the next sheet. Also disclosed are methods for turning pages in a hands-free manner.

11 Claims, 6 Drawing Sheets

HANDS-FREE PAGE TURNING FOR SHEET MUSIC

TECHNICAL FIELD

The present invention relates to an apparatus for performing hands-free turning of pages of sheet music.

BACKGROUND

In reading sheet music while performing instrumental music, the musician may need to repeatedly turn the pages of the sheet music. This can be disruptive to the musician's performance. Automatic page turning devices allow musicians to turn pages in a hands-free manner. There are prior designs for such automatic page turning machines. However, they are unwieldy, costly, overly complicated, or unreliable. Also, some automatic page turning machines require tedious preparation by the musician, such as individually loading the separate sheets into the machine, or inserting the sheet music in plastic sleeves. There is a need for an improved automatic page turning machine. In particular, improvements can be made in simplicity of operation, cost-effectiveness, reliability, or visual elegance.

SUMMARY

This invention provides for hands-free turning of sheets in a booklet. In one aspect, this invention is a hands-free page turning apparatus for turning sheets of a booklet. The apparatus could be used for any type of booklet with multiple sheets, such as sheet music booklets or a loose sheet binder (e.g. three-ring binder). In operation, a magnetic fastener (e.g. metal paper clip) is attached to the sheet(s). The apparatus comprises a page turning machine and a hands-free actuator. The hands-free actuator could operate in any suitable manner, such as voice activation, hand gesture recognition, foot-operated, etc. In some embodiments, the actuator is a foot actuator.

Page Turning Machine: The page turning machine comprises a housing for the electromechanical components of the machine. The housing comprises a front panel against which a booklet can be set. Along the bottom of the housing, there is a base plate upon which the booklet can sit. There could be a separation angle between the base plate and the flat plane of the front panel, as explained below. In some embodiments, this separation angle is in the range of 1-15°.

The page turning machine further comprises a swing arm. The size of swing arm is sufficiently long to turn sheets of the booklet. In some embodiments, the length of the swing arm is in the range of 8-31 cm long. The swing arm could be adjustable in length so that it could be used with different sized sheets. The swing arm comprises a magnet for attracting a metal fastener attached to the target sheet (see further explanation below). The magnet could be a permanent magnet or an electromagnet that can be activated/deactivated.

The page turning machine comprises one or more motors coupled to the swing arm for propelling the swing arm. Any suitable type of electric motor(s) could be used in the page turning machine. Stepper-type motors may be particularly useful. The coupling of the motor(s) to the swing arm may be direct or indirect (e.g. via other intervening components such as levers or gears). The motor(s) operate to move the swing arm in a horizontal sweeping motion and also raising/lowering the swing arm in a vertical motion. The vertical motion may be any type of movement that raises/lowers the far end of the swing arm, such as linear translational movement of the entire swing arm or pivoting of only the far end of the swing arm. In some embodiments, there is a swing motor for the horizontal sweeping motion and an elevator motor for raising/lowering the swing arm. In some embodiments, a single motor could be configured to provide both horizontal and vertical motions.

The page turning machine comprises a controller system for operating the motor(s). The controller system may comprise one or more motor drivers for electrically driving the motor(s). In some embodiments, the motor driver limits the amount of current for the motor to a maximum amount, wherein the maximum amount is an amount in the range of 200-800 mA. In some embodiments, in situations where there is a swing motor and an elevator motor, and there is a motor driver for each, the current limit set by the motor driver for the elevator motor is less than the current limit set by the motor driver for the swing motor.

Method: In another aspect, this invention is a method of hands-free page turning sheets in a booklet. This allows the user to turn the sheets without using their hands to turn the sheets. The steps described herein may be performed by the user, the apparatus, or a combination of both. This method may be performed using the apparatus of this invention or any other suitable apparatus.

The sheet may be used in naked form, i.e. not contained in a wrapper, sheath, pocket, sleeve, protector, or other type of separate enclosure. The user attaches a magnetic fastener to one or more sheets of the booklet. The magnetic fastener could be a magnet itself or be a magnetically-responsive metal, such as stainless steel. Particularly suitable are magnetic fasteners that attach to the sheet by easily releasable mechanical coupling and can be attached/released without damaging the sheet, instead of adhesive or pins, etc. The magnetic fastener is attached directly to the sheet. The magnetic fastener may be attached at any suitable location on the sheet. For example, the magnetic fastener may be attached at the top right corner (as viewed facing the front page of the sheet).

The magnetic fastener may be attached to multiple sheets (two or more) of the booklet. In some embodiments, a non-ferromagnetic buffer may be used to separate adjacently positioned magnetic fasteners. This may be useful in avoiding the problem of the swing arm magnet capturing multiple magnetic fasteners (e.g. two paper-clipped sheets) simultaneously. For purposes of defining this particular embodiment, there is one sheet that is defined as a first sheet which has a first magnetic fastener attached thereto; and a next-consecutive sheet that is defined as a second sheet with a second magnetic fastener attached thereto. A non-ferromagnetic buffer is positioned between the first magnetic fastener and the second magnetic fastener. For example, a paper clip (magnetic fastener) may be wrapped in paper tape or have a plastic strip stuck thereto to provide a buffer between that paper clip and an adjacent paper clip on the following sheet.

The swing arm is positioned on the right side with the magnet of the swing arm on the magnetic fastener on the target sheet. The magnet of the swing arm magnetically attaches to the magnetic fastener on the target sheet. As such, the target sheet is attached to the swing arm. The user activates the hands-free actuator (e.g. by depressing a foot pedal). This activates the page turning mechanism. The swing arm moves towards the left side while the target sheet is attached to the swing arm. The swing arm crosses over to the left side and places the target sheet on the left side so that the back page of the target sheet is now facing the user. At this point, the swing arm is behind the just-turned target sheet.

There are various parameters that could optimize the operation of the apparatus. In some embodiments, the duration of the swing arm travel from right-to-left is at least one second long; and in some cases, at least 1.5 seconds long. This duration should be less than 5 seconds. The speed of the swing arm may vary as it travels from right-to-left. For example, starting at a slower speed and then switching to a faster speed may be beneficial, as explained below.

In some embodiments, the swing arm travels at two or more travel speeds as it moves from right-to-left. This motion comprise a first speed and changes to a second speed after the first speed. The second speed is faster than the first speed. The change(s) in speed may be effected by any type of motion such as continuous, gradual, variable, step-wise, non-continuous, etc. In some embodiments, the right-to-left travel of the swing arm comprises a moment of pause in the swing motion. In some cases, the moment of pause is for a duration of at least 0.4 seconds. The moment of pause is brief and should be less than 3 seconds duration.

For turning a second target sheet, the swing arm could make a return stroke back to the right side. The next consecutive sheet is referred to herein as a 'second' target sheet to differentiate from the 'first' target sheet. In the return stroke, the swing arm is raised to a height sufficient to clear the top of the first target sheet. In raising the swing arm, the magnet on the swing arm detaches from the magnetic fastener on the first target sheet. After being raised to a sufficient height, the swing arm is moved back towards the right side. During the return stroke, the swing arm is lowered to a height that aligns with the magnetic fastener on the second target sheet.

On the return stroke, the swing arm may not need motor propulsion for the full duration of the return stroke. In some embodiments, the return stroke comprises a motor-propelled segment and a non-propelled segment that is after the motor-propelled segment, wherein the swing arm continues travel by momentum or gravity during the non-propelled segment. In some embodiments, the swing arm comes to rest on the second target sheet without motor propulsion. This suspension of motor propulsion could happen after the halfway point of the return stroke.

In the apparatus above, the controller system could be programmed to perform the methods described herein. For example, the controller system could be programmed for the swing arm motions and speeds described herein.

BRIEF DESCRIPTION OF THE DRAWINGS

FIG. 1A shows the page turning machine of the apparatus. FIG. 1B shows the foot actuator of the apparatus.

FIG. 3A shows the swing arm ready to be positioned. FIG. 3B shows the swing arm attached to the sheet on the right side, in position to turn the sheet. FIG. 3C shows swing arm in the process of making a page turn. FIG. 3D shows the position of the swing arm as it completes the page turn.

FIG. 4A shows the swing arm being lifted to detach from the just-turned sheet. FIG. 4B shows the swing arm in elevated position so that it is cleared of the just-turned sheet. FIG. 4C shows the swing arm being lowered down as it returns to the right side to engage with the next sheet.

DETAILED DESCRIPTION OF EXAMPLE EMBODIMENTS

Figure 1A:
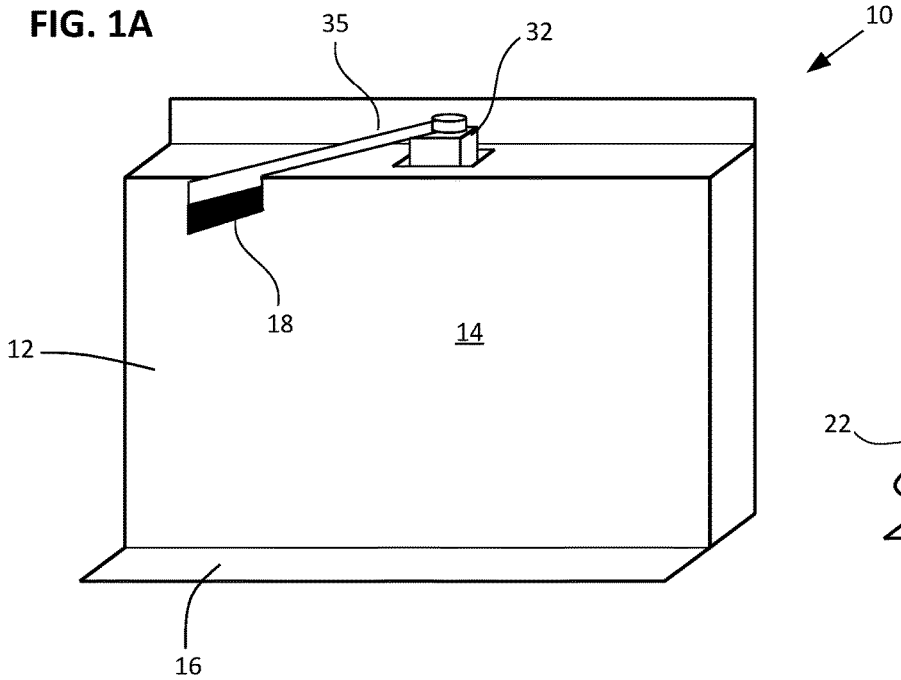
FIGS. 1A and 1B show an example of a hands-free page turning apparatus of the invention.

To assist in understanding the invention, reference is made to the accompanying drawings to show by way of illustration specific embodiments in which the invention may be practiced. The drawings herein are not necessarily made to scale or actual proportions. For example, lengths and widths of the components may be adjusted to accommodate the page size. The inventor has constructed an operational prototype of the hands-free page turner apparatus. The prototype has been operated in various settings: on the display rack of a grand piano, on the display rack of an upright piano, and on a music stand. The inventor has also performed experimental tests on the prototype to find suitable design and operational parameters for better performance. The drawing figures herein show a representational diagram of the actual prototype that was made.

Figure 1B:
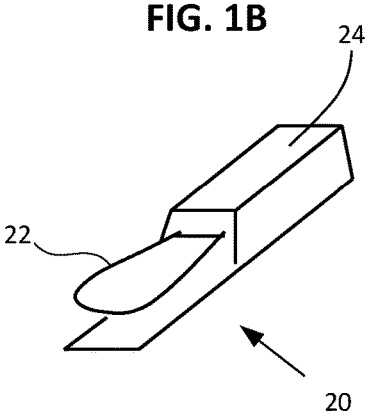

FIGS. 1A and 1B show an example of a hands-free page turning apparatus of this invention. FIG. 1A shows the page turning machine 10 which comprises a housing 12 that houses the internal components of the page turning machine 10. The housing 12 also provides a front panel 14 against which a booklet can be set. Along the bottom edge of the housing 12 is a base plate 16 upon which the booklet can be supported. The page turning machine 10 has a swing arm 35 with a magnetic strip 18 attached at its far end. The swing arm 35 is attached to a swing motor 32 that moves the swing arm 35 in a back-and-forth horizontal sweeping motion.

Figure 2:
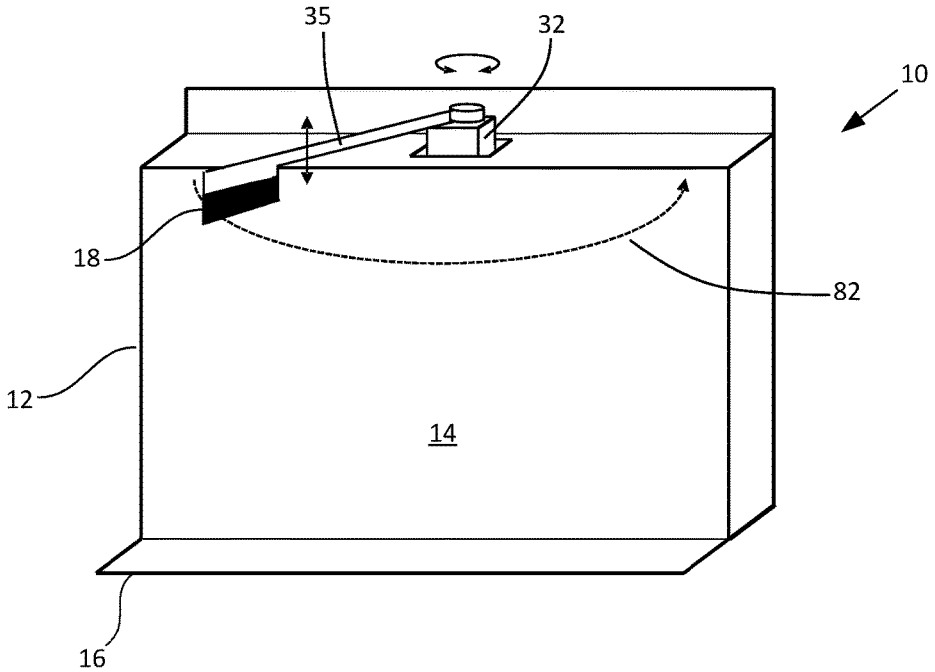
FIG. 2 shows the page turning machine without a sheet music booklet displayed thereon.

FIG. 1B shows the foot actuator 20 that is also part of the automatic page turner apparatus. Foot actuator 20 operates with the page turning machine 10 to activate page turning in a hands-free manner. Foot actuator 20 comprises a base 24 and a foot pedal 22. Foot actuator 20 also contains electronic components for wireless communication (e.g. radio transmitter) with the page turning machine 10. (In an embodiment, the communication line may be via a wired connection). In operation, the user depresses the foot pedal 22 to cause a wireless signal to be transmitted to the controller mechanism inside page turning machine 10. This signal activates the page turning operation. FIG. 2 shows the two ways that the swing arm 35 can move: vertically (shown by the up/down arrows) and in a horizontal arc 82.

Figure 3A:
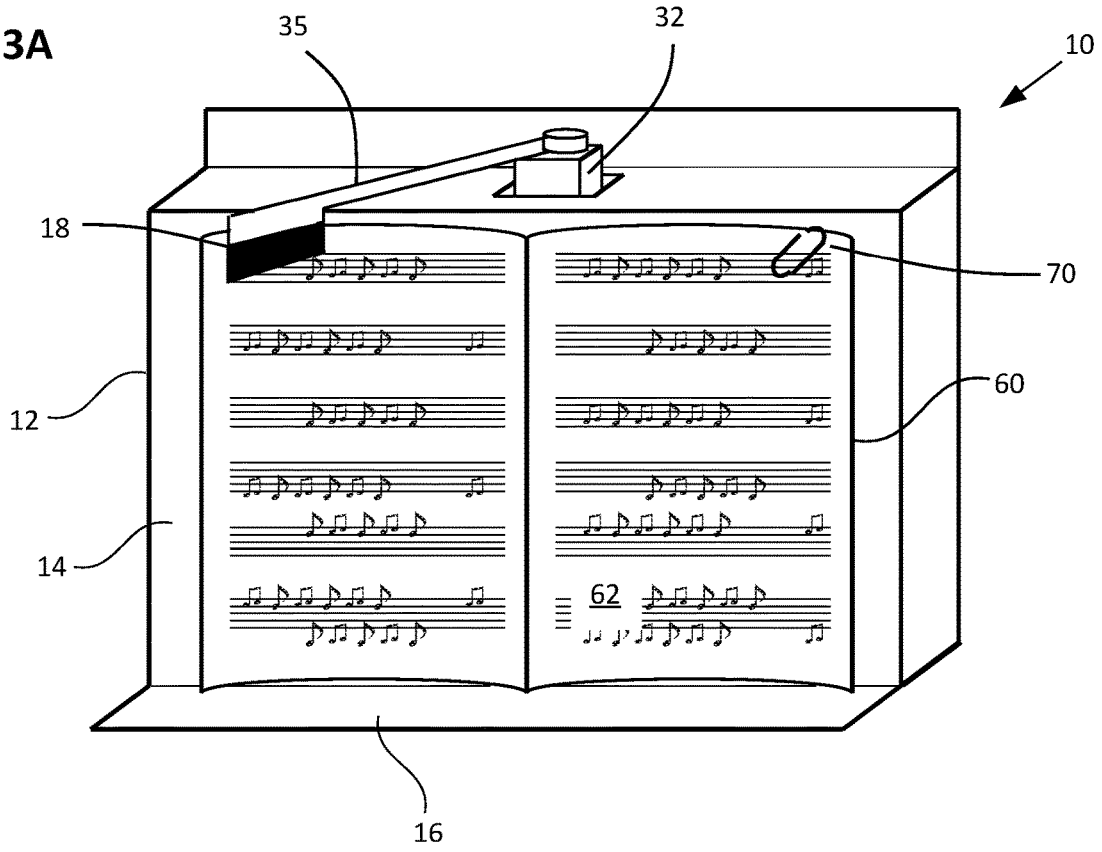
FIGS. 3A-3D show the page turning machine with a sheet music booklet displayed thereon.

FIGS. 3A-3D show the page turning machine 10 in operation. FIG. 3A shows the page turning machine 10 with a booklet of sheet music laid thereon. The terms "left" and "right" as used herein are in relative to the user facing the page turning machine 10. The booklet has a sheet 60 with a front-facing page 62. A metal paper clip 70 is attached to the top right corner of the sheet 60 (as viewed at the front-facing page). The swing arm 35 is swung over to the right side so that its magnetic strip 18 is attached to paper clip 70 by magnetic attraction. This initial positioning of the swing arm 35 could be performed manually by the user.

Figure 3B:
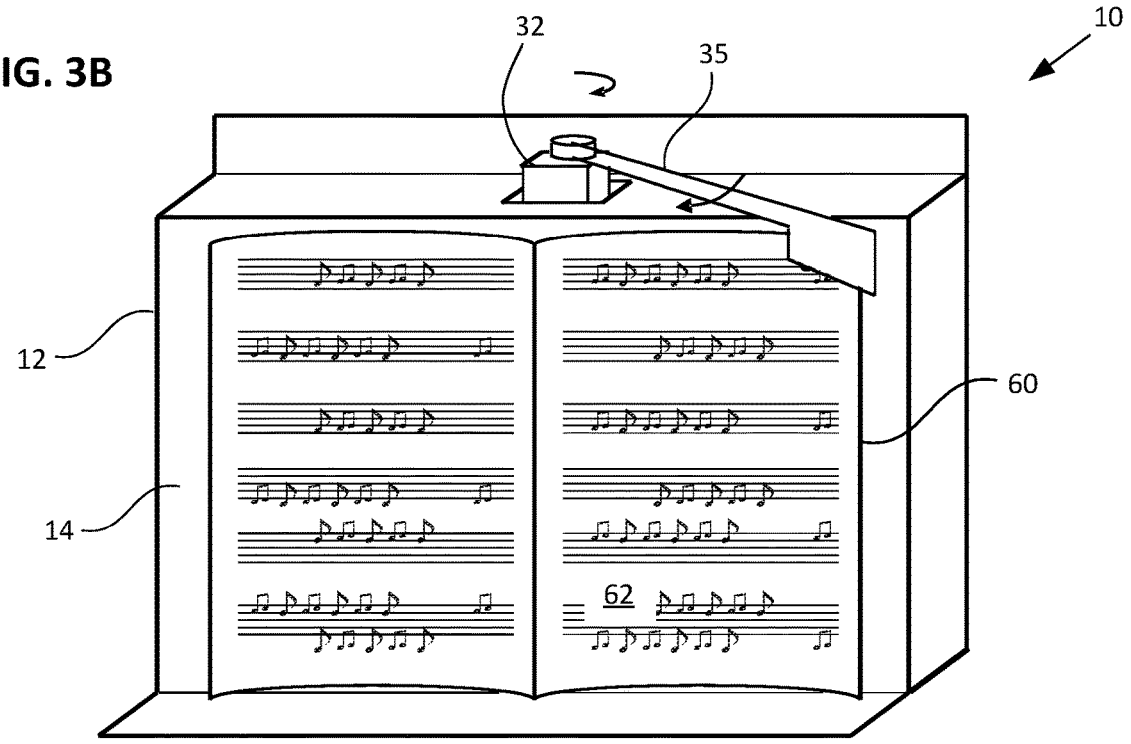
Figure 3C:
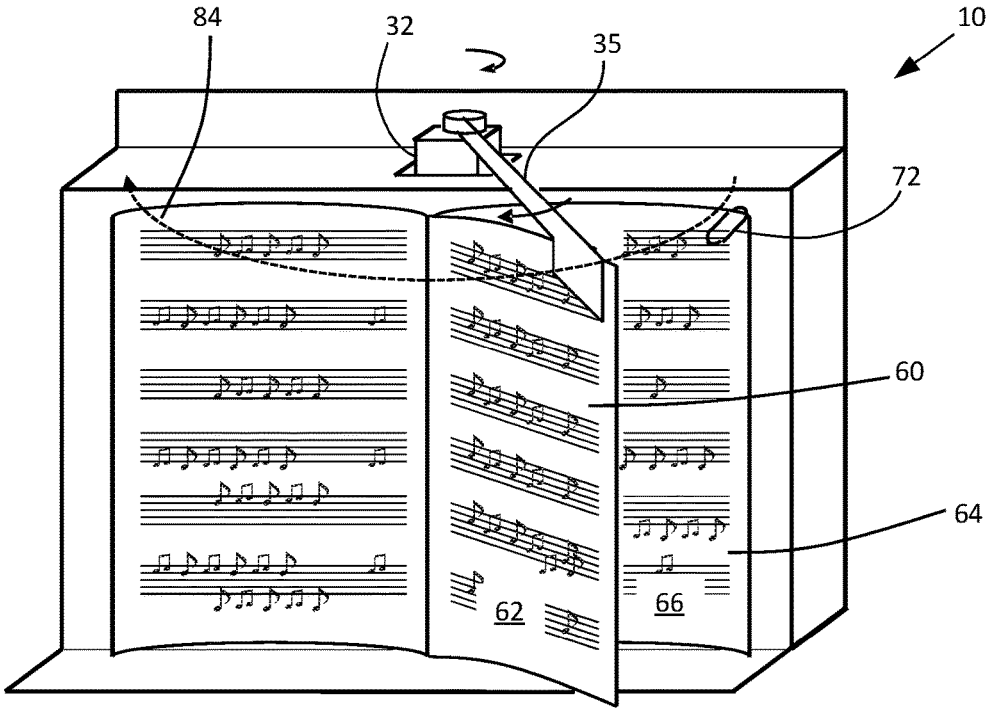

FIG. 3B shows the swing arm 35 in position ready to turn the sheet 60. When the user presses the foot pedal 22 (see FIG. 1B), the page turning operation is activated. The swing motor 32 rotates the swing arm 35 in the direction shown by the arrows. FIG. 3C shows the swing arm 35 continuing to travel along the path of arc 84. The sheet 60, being magnetically attached, is carried along this path by the swing arm 35. This also shows an interim position for the swing arm 35 in turning the sheet 60. At this interim position along its travel path, the swing arm 35 could momentarily stop so that if the next consecutive sheet 64 is inadvertently picked up by the swing arm 35, that sheet 64 could fall back into position. This inadvertent pick-up of sheet 64 could happen because of static attraction or vacuum suction created by preceding sheet 60, or by pass-through magnetic attraction to paper clip 72. Experimental testing has shown that a momentary pause of 0.7 seconds or longer works well.

The swing arm 35 could be made to change speed as it traverses the arc 84, with acceleration or deceleration according to program. Specifically, the swing arm 35 could start slower as it swings from left-to-right and then change to a faster speed. Having this type of variable speed could produce three benefits: (1) reducing the possibility of the magnetic strip 18 detaching from the paper clip 70; (2) reducing aerodynamic drag against the rightward travel of the sheet 60; and (3) giving the swing arm 35 motion a more elegant effect.

Figure 3D:
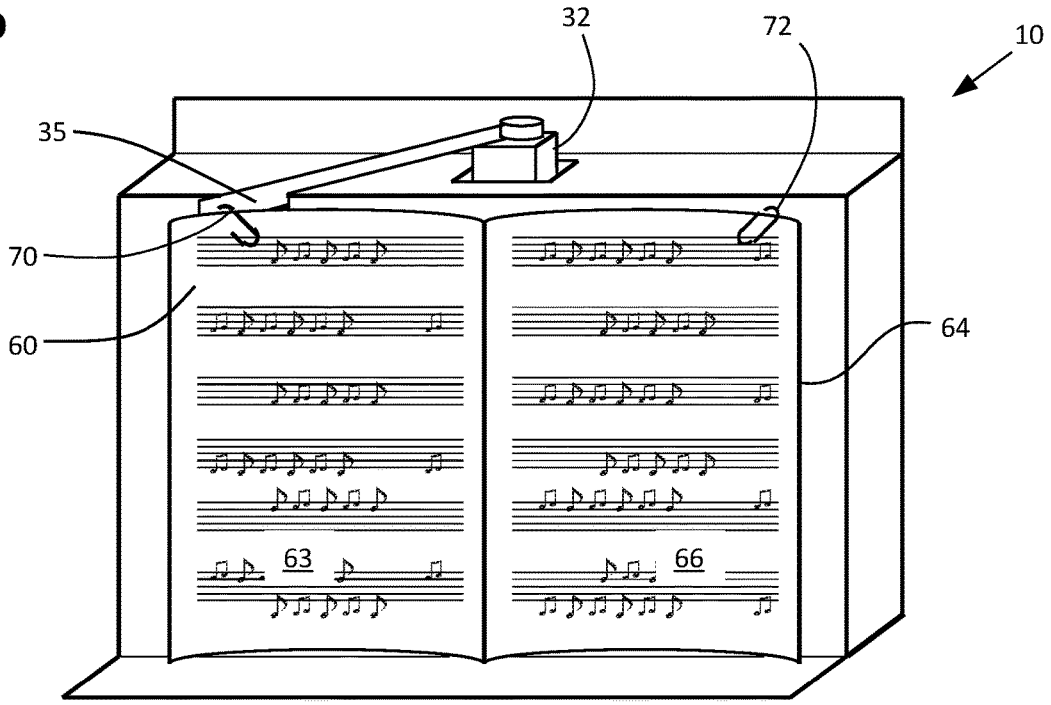

The arc 84 traveled by the far end of the swing arm 35 is of sufficient width to avoid bending of the sheet 60 as it is being turned. FIG. 3D shows the completed page turning operation and the swing motor 35 stops. With page turning completed, the back page 63 of sheet 60 and the front page 66 of sheet 64 are now facing the user.

The strength of the magnetic strip 18 is chosen such that its magnetic strength is strong enough to pull a single sheet, but not too strong that is pulls two sheets at a time or prevents releasing of the just-turned sheet 60. Experimental testing has shown that a flexible magnet strip with a thickness in the range of 1/16-3/16 inch works well.

Figure 4A:
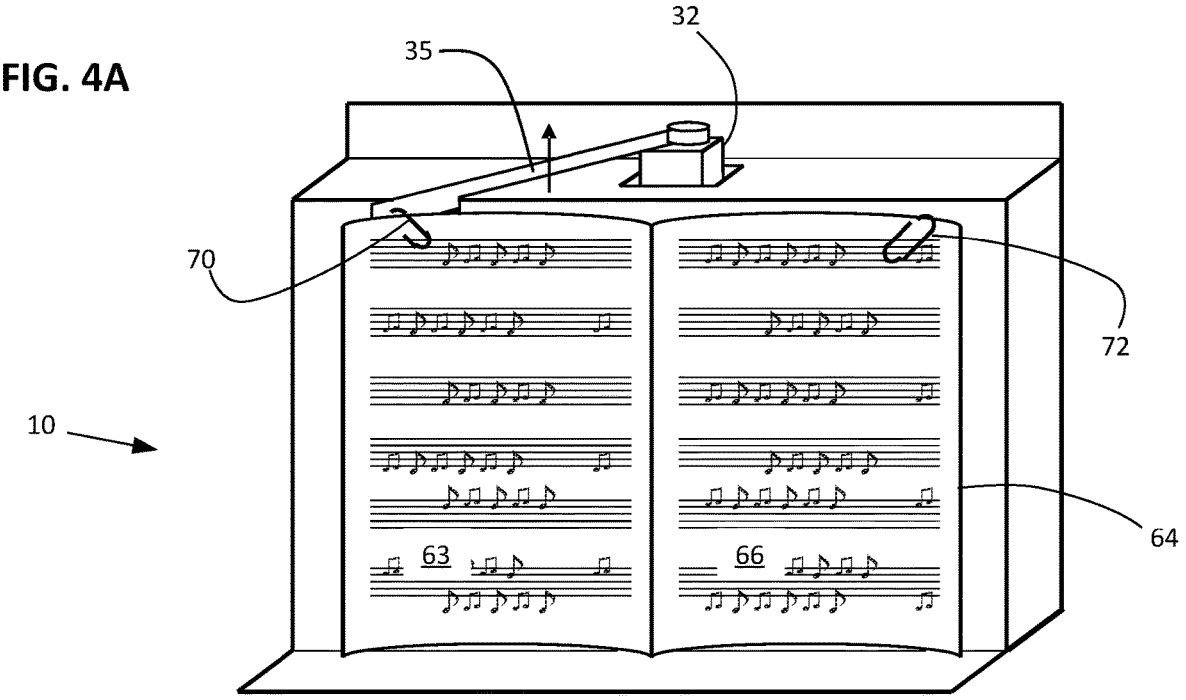
FIGS. 4A-4C show the return stroke of the swing arm.
Figure 4B:
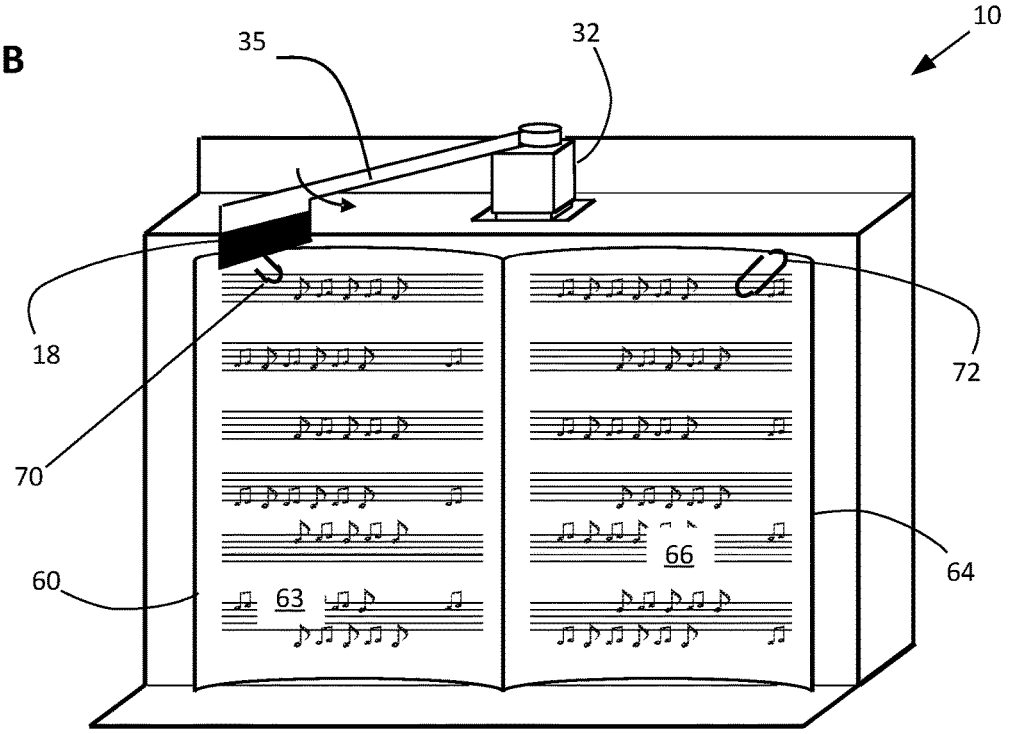
Figure 4C:
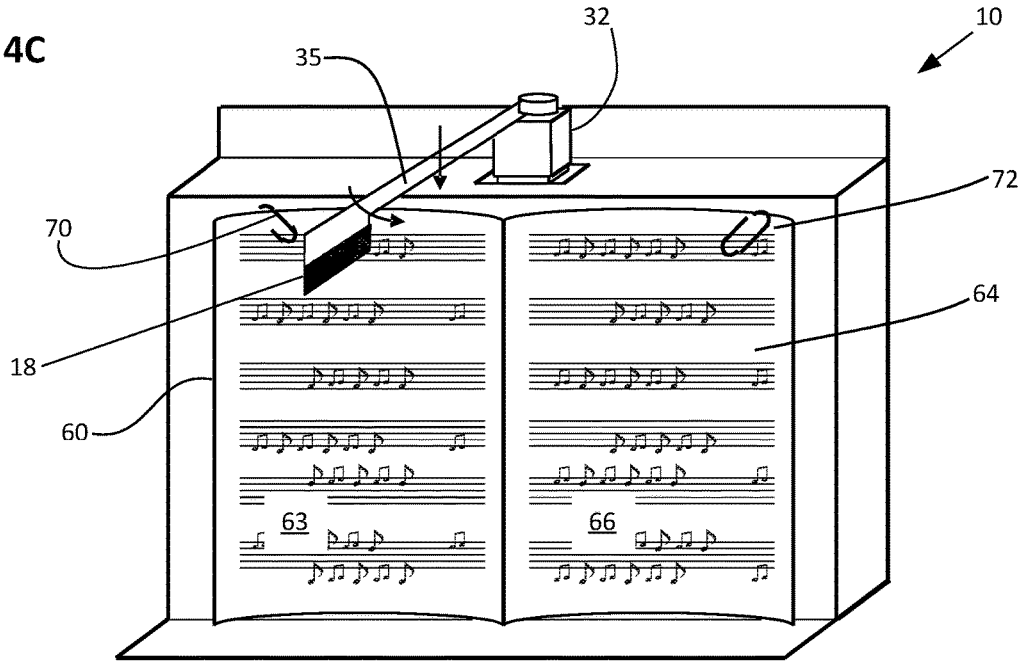

FIGS. 4A-4C show the swing arm 35 returning back to the 'ready' position. FIG. 4A shows the far end of swing arm 35 positioned behind the just-turned sheet 60. To move the swing arm 35 into position to turn the next sheet 64, it is lifted upward (by elevator motor 37, see FIG. 6) as shown by the up arrow. The vertical sliding motion by the magnetic strip 18 (not seen in this view) across the paper clip 70 facilitates detachment. FIG. 4B shows the swing arm 35 and magnetic strip 18 released from the just-turned sheet 60 and having a clear path for the return swing back to the right side in the direction of the right arrow.

FIG. 4C shows the swing arm 35 as it continues to swing to the right side in preparation for turning the next sheet 64. At roughly this position (or any position where the swing arm 35 has cleared itself from the just-turned sheet 60), the swing arm 35 is lowered to its beginning lower height. The swing arm 35 continues on this rightward path until the magnetic strip 18 magnetically attaches to paper clip 72 on the next sheet 64, so that it is ready to turn this next sheet 64. The swing motor 32 rests until the user actuates the page turning mechanism again.

It may be useful to deactivate the swing motor 35 shortly before the swing arm 35 reaches the next sheet 64. This allows gravity and momentum to gently finish the return stroke of swing arm 35 so that it stops naturally when it comes to rest on next sheet 64. This avoids having to program the page turning machine 10 with a pre-determined stop location for swing arm 35 under the drive operation of the arm motor 32.

Figure 5:
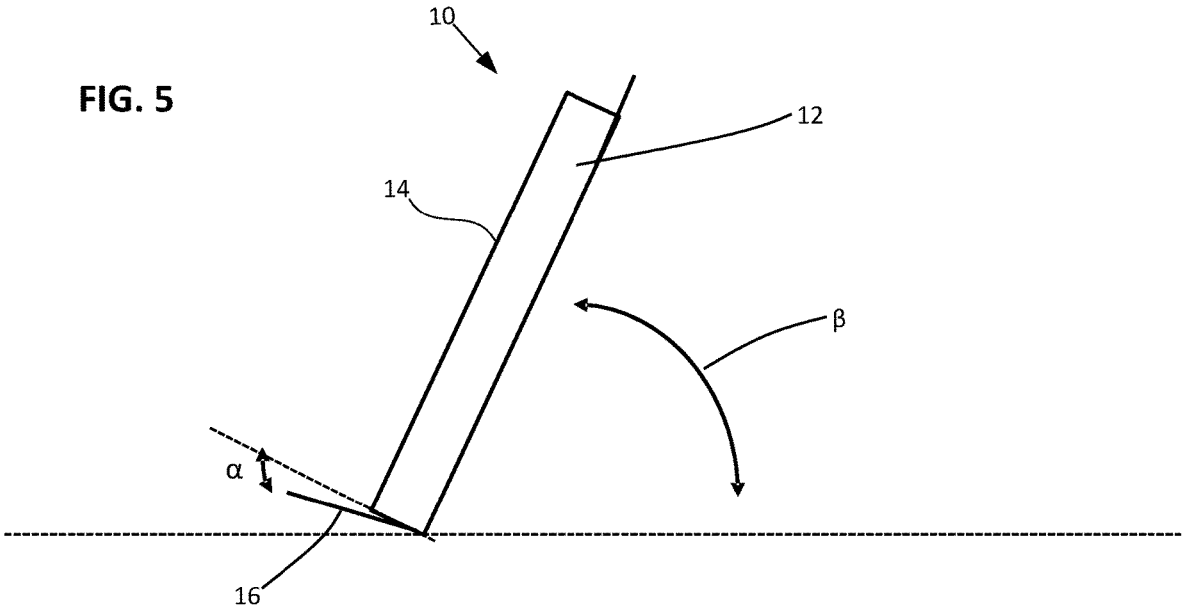
FIG. 5 shows a side view of the page turning machine, indicating the tilt angle of the page turner and the angle of the base plate.

FIG. 5 shows a side view of the page turning machine 10. This view shows the tilt angle of the page turning machine 10 in operational posture. In use, the page turning machine 10 could be placed on any suitable support, such as on a piano display rack or on a music stand. This gives the front panel 14 a sufficient tilt angle β which could help to reduce the chance of swing arm 35 capturing two sheets simultaneously. Experimental testing has shown that a tilt angle of 45-70° works well.

FIG. 5 also shows a small angle α for the base plate 16 relative to the flat plane of the front panel 14. If this angle α is 0°, the base plate 16 is orthogonal to the flat plane of the front panel 14. This lack of angular separation may cause friction at the bottom of the turning sheet against the base plate 16. Having a small separation angle α for the base plate 16 may reduce this friction, thereby giving a smoother page turning movement. Experimental testing has shown that 3° separation angle is sufficient to avoid this unwanted frictional interference.

Figure 6:
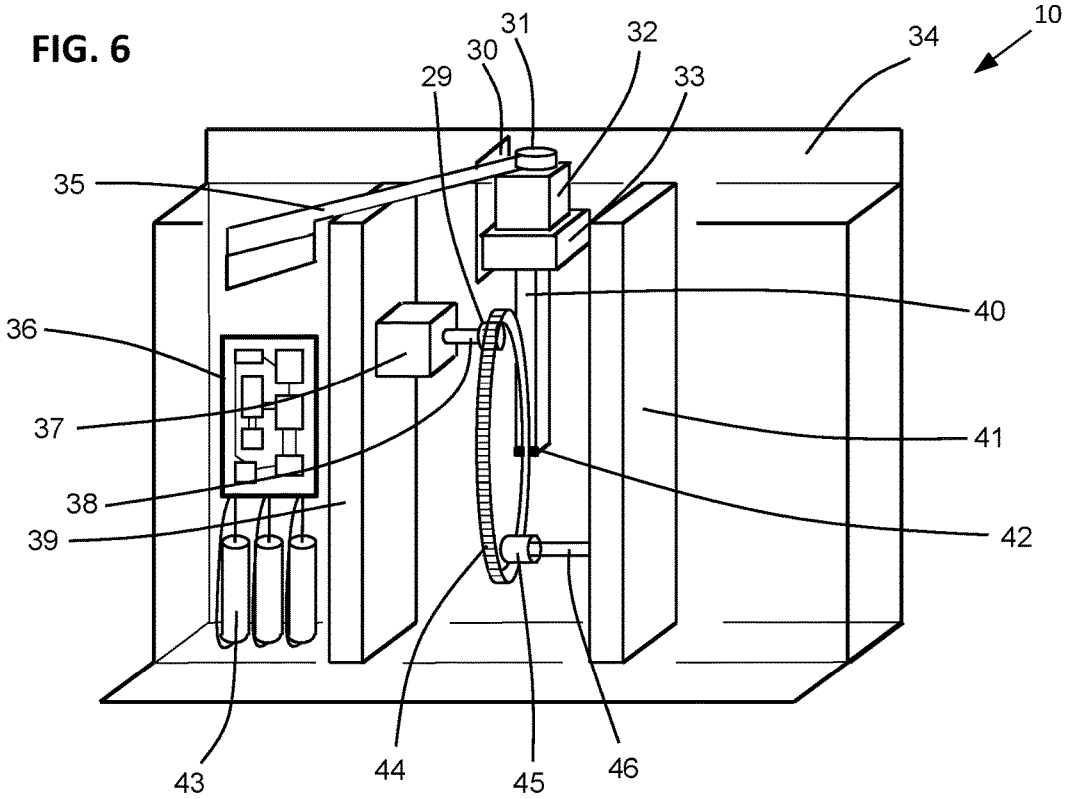
FIG. 6 shows the internal components of the page turning machine.

FIG. 6 depicts the electromechanical components of the page turning machine 10. The electromechanical components include a motor assembly, electric circuitry, and batteries. There are two motors: elevator motor 37 for vertical motion, and swing motor 32 for horizontal motion. Elevator motor 37 operates to move the swing arm 35 vertically up/down. Swing motor 32 rotates the swing arm 35 horizontally in an arc path. Any suitable electric motor could be used. Stepper motors are well-suited for this function because they are accurate without requiring sensors to detect their positions. As an example, an NEMA-11 type stepper motor would work well.

The arm motor 32 is mounted on a platform 33, which in turn is connected to a truss 40. The platform 33 and the truss 40 together (truss assembly 42) could be made using a 3D printer. To move the truss assembly 42 vertically, a belt-drive system could be used. In this system, a belt 44 is attached to the base of the truss assembly 42. The top end of the belt 44 is connected and driven by the elevator motor 37 via a pulley 29 on shaft 38. The bottom end of the belt 44 loops around a ball bearing 45 on a shaft 46. Using a metal ball bearing 45 provides a low friction coupling. Experimental testing has shown that a plastic cylindrical piece created by a 3D printer would also work well. With this belt-drive system, rotating the elevator motor 37 moves the truss assembly 42 along with the arm motor 32 vertically to give up and down vertical motion for the swing arm 35.

The elevator motor 37 and the ball bearing 45 are attached to the structural frame (left 39, right 41) of the page turner. Guide walls provide a sturdy frame for the truss assembly 42 and the swing motor 32. The left side guide wall 30 can be a simple plastic panel produced by a 3D printer. The right side guide wall can just be the right side structural frame 41. All of the parts that need to be affixed or attached could be done using common glues such as super glue, or wood glue if wood is used.

The page turning machine 10 also includes electronic circuitry for controlling the motors. The circuitry can reside on a PC-board 36. Rechargeable batteries 43 can serve as the power source. The batteries 43 may be of lithium-ion type. The circuitry also includes a wireless receiver (e.g. radio) component to receive activation signals from the foot actuator 20.

Figure 7:
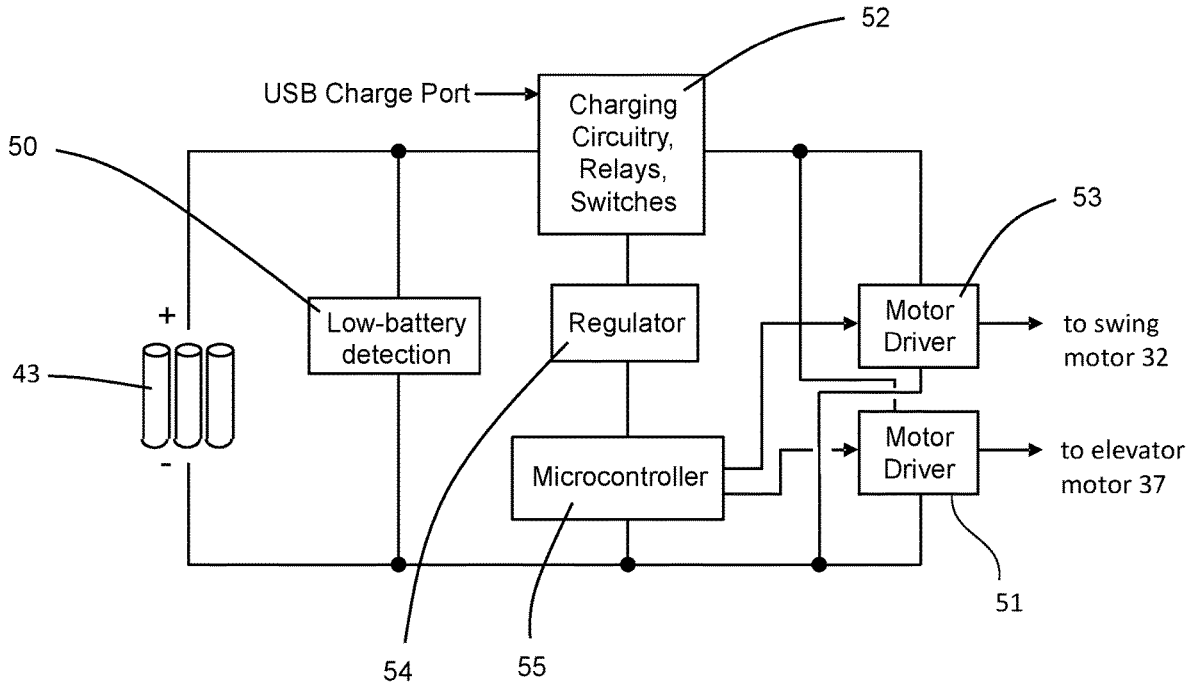
FIG. 7 shows the circuitry that controls the operation of the page turning machine.

FIG. 7 shows the circuit block diagram of the controller system for the page turning machine 10. Batteries 43 are connected to the relays, switches, and charging circuitry 52 which control power switching and charging when the charging cable is plugged in. Widely available USB wall charger/cable sets may be used for recharging. Low-battery detection circuitry 50 lights an LED when the battery voltage is low to indicate the necessity for recharging. The regulator 54 provides a DC-DC voltage conversion for the microcontroller 55 which typically requires a lower supply voltage, for example 3.3 volts. Motor drivers 51,53 drive the stepper motors. Microstepping-type motor drivers are suitable because they allow quiet operation of the motors. Such motor drivers could also limit current output to reduce power consumption. The DRV-8825 motor driver module is an example of such a motor driver. The current output could be limited to an amount that is just high enough to give sufficient torque in the motors 32,37 while dissipating less power. Experimental testing has shown that 300 mA current limit is a good setting for the elevator motor 37, and 380 mA current limit is a good setting for the swing motor 32.

Further reduction in power consumption can be achieved by disabling the motor drivers 51,53 when the motors 32,37 need not be active. For example, swing motor 32 could be disabled in the interval between page turning operations, or when the swing arm 35 is allowed to make the return swing naturally without motor propulsion. The elevator motor 37 can be disabled for most of the duration of operation.

The descriptions and examples given herein are intended merely to illustrate the invention and are not intended to be limiting. Each of the disclosed aspects and embodiments of the invention may be considered individually or in combination with other aspects, embodiments, and variations of the invention. In addition, unless otherwise specified, the steps of the methods of the invention are not confined to any particular order of performance. Modifications of the disclosed embodiments incorporating the spirit and substance of the invention may occur to persons skilled in the art, and such modifications are within the scope of the invention.

Any use of the word "or" herein is intended to be inclusive and is equivalent to the expression "and/or," unless the context clearly dictates otherwise. As such, for example, the expression "A or B" means A, or B, or both A and B. Similarly, for example, the expression "A, B, or C" means A, or B, or C, or any combination thereof.

The invention claimed is:

1. A method of hands-free page turning of sheets in a booklet, comprising:

attaching a first magnetic fastener to a first target sheet in the booklet;

attaching a second magnetic fastener to a second target sheet in the booklet, wherein the second target sheet is consecutive to the first target sheet;

having a page turner apparatus that comprises (i)-(vi) below:

(i) a housing comprising a front panel and containing a page turning mechanism, wherein the front panel is part of the housing and is a flat plane surface;

(ii) a flat-shape base plate along a bottom of the housing;

(iii) a swing arm comprising a magnet;

(iv) one or more motors for operating a motion of the swing arm;

(v) a controller system for controlling the one or more motors;

(vi) a hands-free actuator for activating the page turning mechanism, wherein the hands-free actuator is in communication with the controller system;

placing the booklet on the base plate and against the front panel such that both the front panel and the base plate support the booklet, and such that the first target sheet is on a right side with a front page of the first target sheet facing forward;

positioning the magnet of the swing arm on the first magnetic fastener on the first target sheet;

attracting the first magnetic fastener such that the first target sheet is attached to the swing arm;

activating the hands-free actuator;

moving the swing arm towards a left side while the first target sheet is attached to the swing arm;

placing the first target sheet on the left side so that a back page of the first target sheet is facing forward;

in a return stroke, raising the swing arm and moving the swing arm back towards the right side to magnetically attach the magnet on the swing arm to the second magnetic fastener on the second target sheet, wherein the return stroke comprises a motor-propelled segment and a non-propelled segment that is after the motor-propelled segment, wherein the swing arm continues travel by momentum or gravity during the non-propelled segment.

2. The method of claim 1, wherein the first magnetic fastener is attached to a top right corner of the first target sheet.

3. The method of claim 1, wherein the swing arm does not pick up the second target sheet simultaneous with the first target sheet.

4. The method of claim 1, wherein the swing arm travels at two or more travel speeds as it moves from right-to-left, wherein the travel speeds comprise a first speed and a second speed that is after the first speed, wherein the second speed is faster than the first speed.

5. The method of claim 4, wherein the travel speeds comprises a pause in the swing motion of the swing arm, wherein the pause is for a duration of at least 0.4 seconds.

6. The method of claim 1, wherein the swing arm comes to rest on the second target sheet without motor propulsion.

7. The method of claim 1, wherein the non-propelled segment begins after a halfway point of the return stroke.

8. The method of claim 1, wherein the return stroke further comprises lowering the swing arm.

9. The method of claim 1, wherein raising of the swing arm in the return stroke causes the magnet to detach from the first magnetic fastener on the first target sheet.

10. The method of claim 1, wherein the first target sheet is not contained in a separate sleeve.

11. The method of claim 1, wherein the housing is set such that the front panel is at a tilt angle in the range of 45-70°.

* * * * *